US008657272B2

(12) United States Patent
Gurule

(10) Patent No.: US 8,657,272 B2
(45) Date of Patent: Feb. 25, 2014

(54) CASE CLAMP

(75) Inventor: James J. Gurule, Danville, CA (US)

(73) Assignee: Adjustable Clamp Company, Chicago, IL (US)

( * ) Notice: Subject to any disclaimer, the term of this patent is extended or adjusted under 35 U.S.C. 154(b) by 288 days.

(21) Appl. No.: 13/045,282

(22) Filed: Mar. 10, 2011

(65) Prior Publication Data

US 2012/0228815 A1 Sep. 13, 2012

(51) Int. Cl.
*B25B 1/20* (2006.01)

(52) U.S. Cl.
USPC ..... 269/43

(58) Field of Classification Search
USPC ..... 269/43, 45, 71, 75, 3, 6, 143, 249, 246, 269/229, 236, 104, 270; 29/257, 255, 276, 29/278, 559
See application file for complete search history.

(56) References Cited

U.S. PATENT DOCUMENTS

| | | | | |
|---|---|---|---|---|
| 1,194,666 | A | | 8/1916 | Romanowksi |
| 1,402,621 | A | | 1/1922 | Knittel |
| 1,476,628 | A | | 12/1923 | Daniel et al. |
| 1,788,546 | A | | 1/1931 | Schmieder |
| 1,841,196 | A | | 1/1932 | Mass |
| 1,987,826 | A | * | 1/1935 | Heumann ..... 403/73 |
| 2,430,613 | A | | 11/1947 | Hodge |
| 2,599,010 | A | | 6/1952 | Pernitz |
| 2,605,795 | A | | 8/1952 | Tracy |
| 2,642,905 | A | | 6/1953 | Hewat |
| 3,537,337 | A | | 11/1970 | Best |
| 4,093,202 | A | | 6/1978 | Kincaid |
| 4,316,605 | A | | 2/1982 | Zachry et al. |
| 4,552,345 | A | | 11/1985 | Benda et al. |
| 4,607,829 | A | * | 8/1986 | Suska ..... 269/88 |
| 4,957,257 | A | * | 9/1990 | Gonzalez ..... 296/156 |
| 5,005,813 | A | | 4/1991 | Lawrence |
| 5,192,060 | A | | 3/1993 | Novak |
| 5,277,412 | A | | 1/1994 | Pringle |
| 5,318,391 | A | | 6/1994 | Breiner |
| 5,342,031 | A | | 8/1994 | Yu-Fang |
| 5,697,601 | A | | 12/1997 | Gurule |
| 6,098,972 | A | | 8/2000 | Klimach et al. |
| 6,220,589 | B1 | | 4/2001 | Smith, III et al. |

FOREIGN PATENT DOCUMENTS

| | | |
|---|---|---|
| SU | 0908565 | 2/1982 |

* cited by examiner

*Primary Examiner* — Lee D Wilson
*Assistant Examiner* — Nirvana Deonauth
(74) *Attorney, Agent, or Firm* — Cook Alex Ltd.

(57) ABSTRACT

A case clamp is used to properly align two or more cabinet sides and/or gable ends, such as those of European-style cabinet units. The clamp comprises a frame with an upper jaw, a lower jaw, and an alignment wall connected to the upper and lower jaws. The clamp further includes an upper engagement member associated with the upper jaw for movement in a first direction and a side engagement member associated with the lower jaw for movement in a second direction generally perpendicular to the first direction. Corners of the workpieces are placed adjacent to each other and the clamp is applied to the corners. The engagement members are advanced to press the corners into alignment with each other. A surface of the clamp frame also provides an alignment function, resulting in three-dimensional alignment of the workpieces.

16 Claims, 3 Drawing Sheets

CASE CLAMP

BACKGROUND

1. Field of the Disclosure

The present subject matter generally relates to devices for clamping together separate workpieces. More particularly, the present subject matter relates to clamps for attaching or connecting frameless cabinets to each other.

2. Description of Related Art

There are a wide variety of clamps and clamping tools presently provided to satisfy the needs of different applications and workpieces. One common application which benefits from specialized clamps is the installation of cabinets, such as in a home kitchen or closet or in commercial or medical settings. Cabinets come in two broad categories—those having frames and those that are frameless—and there are specialized tools used for installing each. For example, U.S. Pat. No. 5,697,601 to Gurule illustrates a clamp which is useful for installing cabinets with face frames, while U.S. Pat. No. 6,220,589 to Smith, III and Gurule illustrates a clamp which is useful for installing frameless or "European-style" cabinets. Both of the foregoing patents are incorporated herein by reference.

The clamps described in U.S. Pat. No. 6,220,589 have proven to be useful in frameless cabinet installation by providing a force against the front faces of adjacent cabinets (to align the front faces) and a lateral force which holds the adjacent cabinets together while the cabinets are fastened to each other. However, this clamp does not provide means for full three-dimensional alignment of the cabinets, so there remains room for improvement.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, clamp is provided for clamping adjacent workpieces in desired alignment with each other. The clamp comprises a first engagement member, a second engagement member, and a third engagement member, with the engagement members being configured to provide forces to the adjacent workpieces in three mutually perpendicular directions.

In another aspect, a clamp is provided for clamping multiple workpieces in desired alignment with each other. The clamp comprises a frame with an upper jaw, a lower jaw, and an alignment wall connected to the upper and lower jaws. The clamp further includes an upper engagement member associated with the upper jaw for movement in a first direction and a side engagement member associated with the lower jaw for movement in a second direction generally perpendicular to the first direction.

In yet another aspect, a method is provided for clamping multiple workpieces in desired alignment with each other. The method involves providing first and second workpieces each having a corner defined by a horizontal wall connected to a vertical wall. A single clamp is applied in contact with the corners of the first and second workpieces to provide forces in three mutually perpendicular directions, thereby holding the vertical walls of the workpieces in contact with each other, aligning the horizontal walls of the workpieces, and aligning front edges of the workpieces.

DESCRIPTION OF THE ILLUSTRATED EMBODIMENTS

The embodiments disclosed herein are for the purpose of providing the required description of the present subject matter. They are only exemplary, and may be embodied in various forms. Therefore, specific details disclosed herein are not to be interpreted as limiting the subject matter as defined in the accompanying claims.

Figure 1:
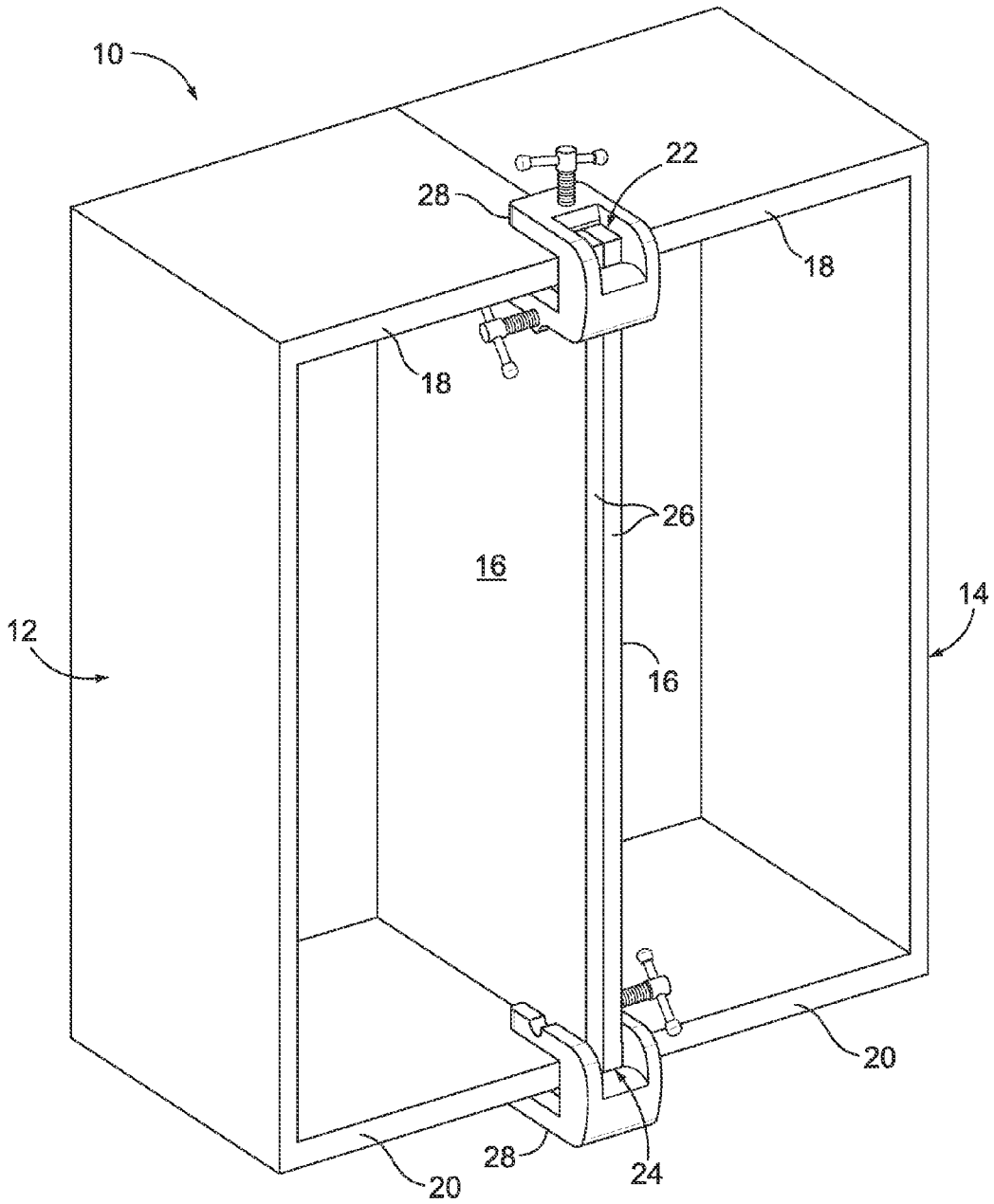
FIG. 1 is a perspective view of two frameless cabinet units fastened together with clamps according to the present disclosure, prior to permanently fastening the cabinets together.

FIG. 1 illustrates a frame-less or European style cabinet, which is indicated generally at 10 and formed of first and second frame-less cabinet units 12 and 14. While clamps according to the present disclosure will be described in reference to the cabinet units 12 and 14 of FIG. 1, the clamps may be used with any frameless workpieces to be joined together.

Each cabinet unit 12, 14 comprises a vertical side wall or upright 16 which is to be joined to the vertical side wall 16 of the adjacent cabinet unit. Any directional terms (e.g., "vertical" or "horizontal" or "upper" or "lower") used herein refer to the configuration of FIG. 1 and are used for the purpose of describing one method of using clamps according to the present disclosure and are not intended to be limiting or require a particular orientation of the workpieces and/or clamps, unless stated to the contrary.

Each cabinet unit 12, 14 also includes at least one horizontal wall 18 that is connected to an end of the associated vertical wall 16 to define a corner. In the illustrated embodiment, each cabinet unit 12, 14 includes an upper horizontal wall 16 and a lower horizontal wall 20 connected to the ends of the associated vertical wall 16 to define an upper corner 22 and a lower corner 24, respectively.

The abutting vertical walls 16 of the cabinet units 12 and 14 are to be joined together as shown in FIG. 1 prior to installation of the assembled double unit cabinet 10 against a kitchen wall, for example. From FIG. 1 it will be apparent that the front edges 26 of the cabinet units 12 and 14 must be aligned in flush relationship before the cabinet units 12 and 14 are permanently joined together into the cabinet 10. Similarly, the horizontal walls 16, 20 of the cabinet units 12 and 14 must be aligned at the same elevation (i.e., so that the cabinet 10 has a uniform height, with the horizontal walls 16 and 20 of the two cabinet units 12 and 14 defining flat upper and bottom surfaces of the cabinet 10, respectively).

To so join the cabinet units 12 and 14, a corner (illustrated as the upper corner 22 in FIG. 4) of one of the cabinet units 12 is generally aligned with the corresponding corner 22 of the other cabinet unit 14, with the vertical walls 16 at least adjacent to each other, if not pressed together. With the cabinet units 12 and 14 so positioned, a clamp 28 of the present disclosure is positioned at the generally aligned corners 22 and movable elements of the clamp 28 are advanced to bring the cabinet units 12 and 14 into three-dimensional alignment. FIG. 4A shows the top horizontal walls 16 aligned with each other (i.e., y-axis alignment) and the vertical walls 16 pressed flush against each other (i.e., x-axis alignment). FIG. 4B shows that the clamp 28 also serves to align the front edges 26 of the cabinet units 12 and 14 (i.e., z-axis alignment). As shown in FIG. 1, a second clamp 28 may be applied to the other adjacent corners 24 of the cabinet units 12 and 14 for additional alignment support.

With the cabinet units 12 and 14 held in proper alignment by the clamp(s) 28, the vertical walls 16 may be secured together, e.g., using screws or other mechanical fasteners. When the vertical walls 16 have been suitably secured together, the clamp(s) 28 may be removed, leaving the cabinet units 12 and 14 secured to each other as a properly aligned and constructed cabinet 10.

Figure 2:
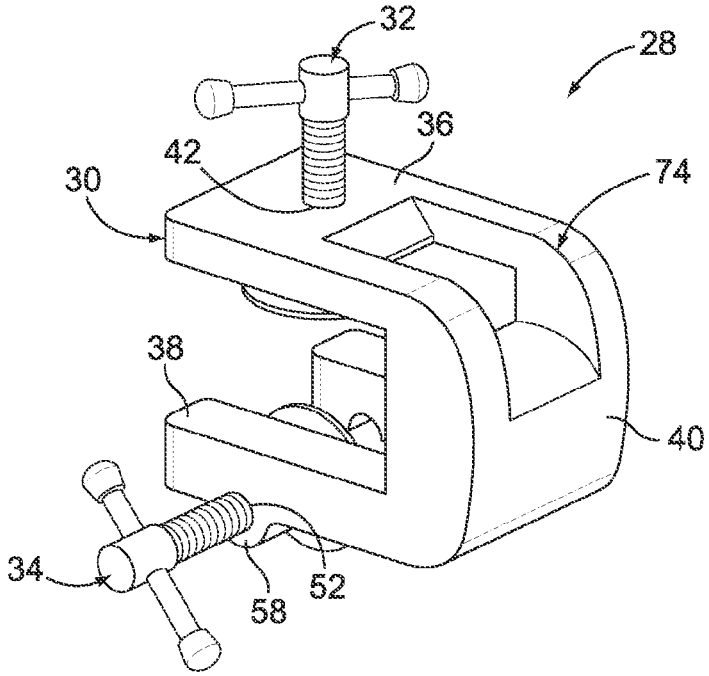
FIG. 2 is a rear perspective view of one of the clamps of FIG. 1.
Figure 3:
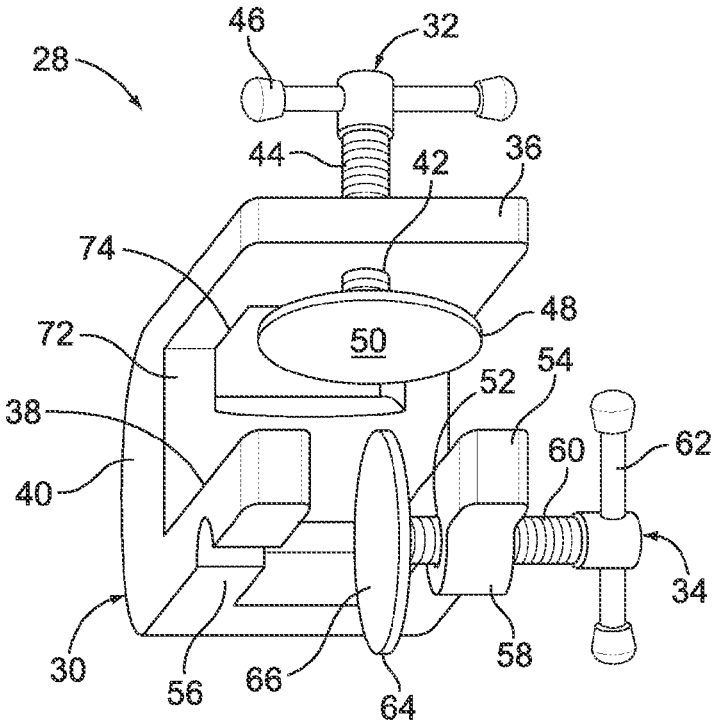
FIG. 3 is a front perspective view of the clamp of FIG. 2.

Referring to FIGS. 2 and 3, the clamp 28 comprises three main components, namely, a frame 30, a first or upper engagement member 32 movably connected to the frame 30, and a second or side engagement member 34 connected to the frame 30.

The frame 30 is generally U- or C-shaped, with an upper jaw 36, a lower jaw 38, and an alignment wall 40 connected to the upper and lower jaws 36 and 38. In the illustrated embodiment, the upper jaw 36 generally defines a plane (a horizontal plane in the illustrated orientation), with the lower jaw 38 extending in a direction generally parallel to the upper jaw 36. The alignment wall 40 is illustrated as extending in a direction generally perpendicular to the upper jaw 36 (i.e., vertically in the illustrated orientation).

The frame 30 is preferably an integrally formed structure, though it is also within the scope of the present disclosure for the frame 30 to be comprised of a plurality of components secured to each other. In one embodiment, the frame 30 is comprised of die-cast aluminum, though other materials (preferably high strength materials, such as metallic materials) and manufacturing methods may also be employed without departing from the scope of the present disclosure.

The upper jaw 34 includes a bore 42 therethrough which receives a shaft 44 of the upper engagement member 32. In a preferred embodiment, the bore 42 is threaded to engage a threaded shaft 44 of the upper engagement member 32. The bore 42 directs the movement of the upper engagement member 32 which, in the illustrated embodiment, is generally perpendicular to the plane of the upper jaw 34 (i.e., vertical in the illustrated orientation). Thus, if the bore 42 and shaft 44 are threadingly engaged, rotation of the threaded shaft 44 about its longitudinal axis moves the upper engagement member 32 through the bore 42. The upper engagement member 32 may include a handle 46 to be gripped and manipulated for movement of the upper engagement member 32 through the bore 42.

The end of the shaft 44 opposite the handle 46 may include an upper pressure plate or contact member 48 for engagement against a workpiece (FIG. 4A). The upper pressure plate 48 is larger than the associated shaft 44 (i.e., it has a larger surface area than the cross-sectional area of the shaft 44). An enlarged upper pressure plate 48 is advantageous in allowing it to simultaneously contact two workpieces 12 and 14 (FIG. 4A) while distributing the alignment force over a larger area to prevent damage to the workpieces 12 and 14. The upper pressure plate 48 is illustrated with a substantially circular shape (FIG. 3), though other shapes (e.g., rectangular or square) may also be employed without departing from the scope of the present disclosure.

The illustrated upper pressure plate 48 has a flat or planar face 50 for bearing against workpieces when the upper engagement member 32 is advanced to a sufficient degree. Additional steps may be taken to prevent the upper pressure plate 48 from damaging or marking the workpieces. For example, in one embodiment, the face 50 of the upper pressure plate 48 has a relatively soft finish (e.g., a felt or fabric pad secured thereto). In another embodiment, the upper pressure plate 48 may be comprised of a softer material than the (preferably metallic) shaft 44, such as a rubber or elastomeric material.

Additionally, the upper pressure plate 48 may be non-fixedly secured to the shaft 44, such as by a ball and socket joint, which allows the upper pressure plate 48 to resist rotation upon sufficient frictional force (e.g., when the upper pressure plate 48 is moved into contact with workpieces and the upper engagement member 32 is continuously advanced toward the workpieces for improved alignment). Such a feature may be advantageous because rotation of the upper pressure plate 32 while in contact with the workpieces could possibly mark the workpieces. Further, allowing the upper pressure plate 48 to pivot or move with respect to the associated shaft 44 may be beneficial in properly aligning the subject workpieces. However, it is also within the scope of the present disclosure for the upper pressure plate 48 (if provided) to be rigidly secured to the associated shaft 44.

The lower jaw 38 also includes a bore 52 for receiving a side engagement member 34. In the illustrated embodiment, the lower jaw 38 is comprised of a first leg 54 and a second leg 56, with the bore 52 being defined in one of the legs. In the illustrated embodiment, the bore 52 is associated with the first leg 54, but it may instead be associated with the second leg 56. The legs 54 and 56 are spaced apart from each other to accommodate workpieces therebetween (FIGS. 4-4B) and extend in a direction generally parallel to the upper jaw 36. The illustrated legs 54 and 56 are substantially identical to each other, though whichever leg includes the bore 52 may include additional material (shown in FIGS. 2 and 3 as a semi-circular extension 58 from a surface of the first leg 54) to accommodate and partially define the bore 52.

Similar to the bore 42 of the upper jaw 36, the bore 52 of the lower jaw 38 receives the shaft 60 of an associated side engagement member 34. In a preferred embodiment, the bore 52 is threaded to engage a threaded shaft 60 of the side engagement member 34. The bore 52 directs the movement of the side engagement member 34 which, in the illustrated embodiment, is generally perpendicular to the movement of the upper engagement member 32 (i.e., horizontal in the illustrated orientation). Thus, if the bore 52 and shaft 60 are threadingly engaged, rotation of the threaded shaft 60 about its longitudinal axis moves the side engagement member 34 through the bore 52 toward and away from the second leg 56. The side engagement member 34 may include a handle 62 for facilitating movement of the side engagement member 34 through the bore 52.

The end of the shaft 60 opposite the handle 62 may include a side pressure plate or contact member 64 for engagement against a workpiece (FIGS. 4A and 4B). The side pressure plate 64 is larger than the associated shaft 60, which advantageously distributes the alignment force over a larger area to prevent damage to the impacted workpiece. The side pressure plate 64 is illustrated with a substantially circular shape, though other shapes (e.g., rectangular or square) may also be employed without departing from the scope of the present disclosure. The shapes and sizes of the upper and side pressure plates 48 and 64 may be the same or different.

The illustrated side pressure plate 64 has a flat or planar face 66 (FIG. 3) for bearing against a workpiece when the side engagement member 34 is advanced to a sufficient degree. Additional steps may be taken to prevent the side pressure plate 64 from marking a workpiece, including those described previously with regard to the upper pressure plate 48.

It may be advantageous for the legs 54 and 56 to include one or more flat surfaces. In particular, it may be advantageous for the upper surfaces 68 of the legs 54 and 56 (i.e., those surfaces which face the upper jaw 36) to be substantially flat, as they may bear against the workpieces during use. Additionally, it may be advantageous for an inwardly facing surface 70 of the second leg 56 (i.e., the surface of the leg 56 which faces the side engagement member 34) to be flat because it typically bears against a workpiece during use (FIGS. 4A and 4B).

Figure 4:
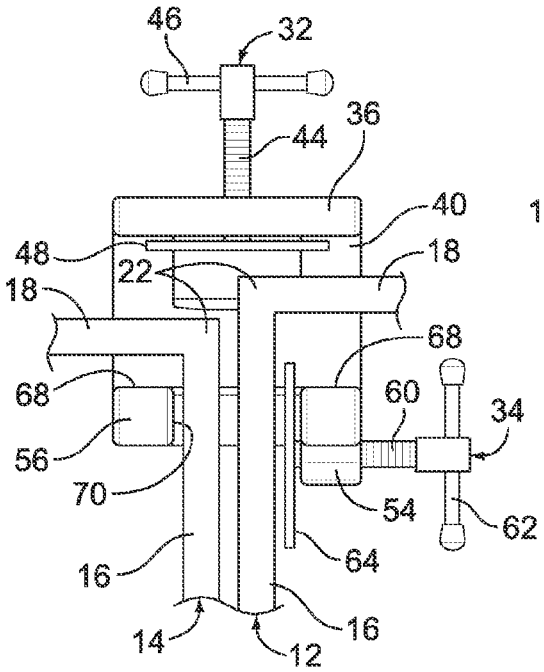
FIG. 4 is a front elevational view of the clamp of FIG. 2, receiving adjacent, unaligned workpieces.
Figure 4A:
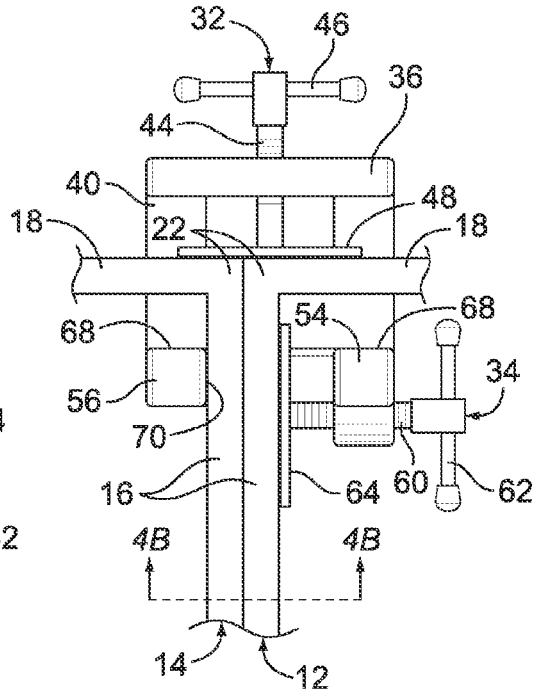
FIG. 4A is a front elevational view of the clamping arrangement of FIG. 4, with the adjacent workpieces being aligned.
Figure 4B:
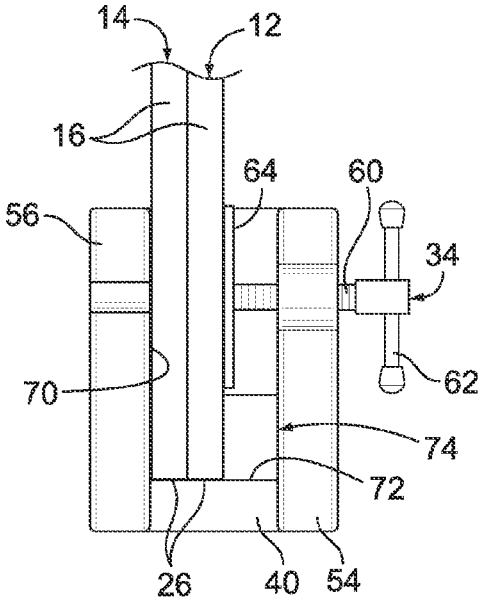
FIG. 4B is a bottom elevational view of the clamping arrangement of FIG. 4, with the adjacent workpieces being aligned.

As for the alignment wall 40 of the frame 30, it is preferably sized to provide sufficient separation to accommodate the horizontal walls 18 of the workpieces 12 and 14 between the upper engagement member 32 and the lower jaw 38 during use (FIGS. 4 and 4A). The alignment wall 40 serves as a third engagement member which, along with the other two engagement members 32 and 34 provides a contact force to adjacent workpieces to bring them into alignment with each other. In particular, the alignment wall 40 has a (preferably flat) face 72 which is pressed against the front edges 26 of the workpieces 12 and 14 during use (FIG. 4B) to provide an aligning force (i.e., z-axis alignment). The alignment wall 40 is not movable with respect to the rest of the frame 30 (unlike the upper and side engagement members 32 and 34), so it must be pressed against the front edges 26 when the clamp 28 is first installed onto the workpieces 12 and 14. When the alignment wall 40 is properly positioned, the upper and/or side engagement members 32 and 34 may be tightened to hold the alignment wall 40 against the front edges 26 of the workpieces 12 and 14.

The frame 30 may also include a viewing window or opening 74 for improved visibility of the workpieces when the clamp 28 is secured thereto. Further, in some applications the subject workpieces are to be connected together with a hinge, in which case the viewing window 74 may be sized and oriented to allow for a hinge to be applied therethrough to the underlying workpieces without removing the clamp 28. In the illustrated embodiment, the viewing window 74 occupies a portion of the upper jaw 36 and a portion of the alignment wall 40, being positioned generally at the edge or intersection between the upper jaw 36 and the alignment wall 40. However, the shape and location of the viewing window 40 in the illustrated embodiment is merely exemplary and other shapes and locations may be employed without departing from the scope of the present disclosure.

In use, the separate cabinet units 12 and 14 will be placed together in approximately the position they will occupy when properly joined together to form the assembled cabinet 10. A clamp 28 is applied to receive the corners 22 of the cabinet units 12 and 14, as shown in FIG. 4. FIGS. 4-4B illustrate the process of applying a clamp 28 to the cabinet units 12 and 14 to bring them into proper alignment. FIGS. 4-4B may be considered a "reverse angle" of the viewpoint of FIG. 1, as they show the interior of the clamp 28 during use, rather than the rear or outside portion of the clamp 28 (as in FIG. 1).

The clamp 28 may be applied to either the upper corners 22 of the cabinet units 12 and 14 (as shown in FIG. 4) or to the lower corners 24 of the cabinet units 12 and 14. A second clamp 28 may be applied to receive the other corners of the cabinet units 12 and 14 (FIG. 1). If two clamps 28 are applied, they may both be applied to the respective corners of the cabinet units 12 and 14 and then secured thereto or one clamp 28 may be applied and secured to the associated corners, followed by the other clamp 28 being applied and secured to the associated corners.

When the clamp 28 is applied to the corners 22, the horizontal walls 18 of the cabinet units 12 and 14 are positioned in the space between the upper and lower jaws 36 and 38 (FIG. 4). At the same time, the vertical walls 16 of the cabinet units 12 and 14 are positioned in the space between the legs 54 and 56 of the lower jaw 38 (FIG. 4). The upper and side engagement members 32 and 34 are sufficiently retracted that they do not interfere with proper positioning of the corners 22 within the clamp 28.

With the clamp 28 applied to the corners 22, the engagement members 32 and 34 and alignment wall 40 may be employed to bring the cabinet units 12 and 14 into three-dimensional alignment with each other. The order in which the surfaces of the cabinet units 12 and 14 are brought into alignment with each other may vary, with an exemplary alignment sequence described herein for illustrative purposes.

In an exemplary embodiment, the side engagement member 34 is advanced to bring the side pressure plate 64 into contact with the vertical wall 16 of one of the cabinet units 12. The side engagement member 34 is then further advanced until the side pressure plate 64 presses the vertical walls 16 of the two cabinet units 12 and 14 together between the side pressure plate 64 and the second leg 56 (FIGS. 4A and 4B). At this point, it may be advantageous for the vertical walls 16 to be pressed together with a minor amount of "play" between them, such that they are flush with each other, but allowed to slide against each other for alignment purposes.

With the vertical walls 16 flush with each other, the clamp 28 may be moved toward the cabinet units 12 and 14 to bring the alignment wall 40 of the clamp 28 closer to the front edges 26 of the cabinet units 12 and 14. As the vertical walls 16 are allowed to slide against each other, the alignment wall 40 comes into contact with the front edge 26 of one of the cabinet units 12 and 14 (i.e., whichever is initially closer to the alignment wall 40) and moves it until the alignment wall 40 comes into contact with the front edge 26 of the other cabinet unit, thereby bringing the front edges 26 into alignment (FIG. 4B).

The upper engagement member 32 is then advanced to move it toward the horizontal walls 18 of the cabinet units 12 and 14. As the vertical walls 16 are allowed to slide against each other, the upper pressure plate 48 comes into contact with one of the horizontal walls 18 (i.e., whichever is initially closer to the upper jaw 36) and moves it downwardly until the upper pressure plate 48 comes into contact with the other horizontal wall 18, thereby bringing the horizontal walls 18 into alignment. Further advancement of the upper pressure plate 48 may be halted as soon as the horizontal walls 18 are aligned or may instead continue until the undersides of the horizontal walls 18 are pressed against the legs 54 and 56 of the clamp 28.

As described previously, the order of alignment may be modified. For example, in an alternative method of using clamps according to the present disclosure, the front edges 26 of the workpieces 12 and 14 may be aligned prior to employing the side engagement member 34 to bring the vertical walls 16 into contact with each other. In yet another alternative embodiment, rather than aligning the horizontal walls 18 after the front edges 26 have been aligned, the horizontal walls 18 may instead be aligning prior to aligning the front edges 26.

If desired, a second clamp 28 may be applied to the other abutting corners 24 of the workpieces 12 and 14 (FIG. 1), though a single clamp 28 is often sufficient for proper alignment.

With the workpieces properly aligned, the vertical walls 16 may be secured together, e.g., using screws or other mechanical fasteners. Finally, the clamp(s) 28 may be removed (by retracting the upper and side engagement members 32 and 34), leaving the workpieces 12 and 14 secured to each other as a properly aligned and constructed cabinet 10 (FIG. 1).

It will be understood that the embodiments described above are illustrative of some of the applications of the principles of the present subject matter. Numerous modifications may be made by those skilled in the art without departing from the spirit and scope of the claimed subject matter, including those combinations of features that are individually disclosed or claimed herein. For these reasons, the scope hereof is not limited to the above description but is as set forth in the following claims.

The invention claimed is:

1. A clamp for clamping adjacent workpieces in desired alignment with each other comprising: a first engagement member, a second engagement member; and a third engagement member, wherein the clamp defines a single, common interior region in which two of said engagement members are movable with respect to the other engagement member, and the engagement members are configured to provide forces in three mutually perpendicular directions within the interior region.

2. The clamp of claim 1, wherein at least one of said engagement members is movable with respect to the other engagement members.

3. The clamp of claim 1, further comprising a clamp frame, wherein a portion of the clamp frame defines the third engagement member.

4. The clamp of claim 3, wherein the clamp frame includes an upper jaw, a lower jaw, and an alignment wall connected to the upper and lower jaws, one of said first and second engagement members is movably connected to the upper jaw, the other one of said first and second engagement members is movably connected to the lower jaw, and the alignment wall defines the third engagement member.

5. The clamp of claim 4, wherein said first engagement member is movably connected to the upper jaw, and said second engagement member is movably connected to the lower jaw.

6. The clamp of claim 4, further comprising a viewing window defined in said upper jaw and said alignment wall.

7. The clamp of claim 4, wherein said lower jaw comprises first and second legs.

8. The clamp of claim 7, wherein said other one of said engagement members is movably connected to one of said legs for movement toward and away from the other one of said legs.

9. The clamp of claim 4, wherein the upper jaw defines a generally horizontal plane, the alignment wall extends in a direction generally perpendicular to the upper jaw, and the lower jaw extends in a direction generally parallel to said upper jaw.

10. A clamp for clamping multiple workpieces in desired alignment with each other, comprising a frame comprising an upper jaw; a lower jaw; and an alignment wall configured to apply a force in a first direction and connected to the upper and lower jaws; an upper engagement member associated with the upper jaw for movement in a second direction; and a side engagement member associated with the lower jaw for movement in a third direction generally perpendicular to said second direction, wherein the frame defines a shared interior region into which the upper and side engagement members are movable.

11. The clamp of claim 10, wherein the upper jaw defines a plane, the alignment wall extends in a direction generally perpendicular to the upper jaw, and the lower jaw extends in a direction generally parallel to said upper jaw.

12. The clamp of claim 10, wherein the upper engagement member is threadingly connected to the upper jaw and the side engagement member is threadingly connected to the lower jaw.

13. The clamp of claim 10, further comprising a viewing window defined in said upper jaw and said alignment wall.

14. The clamp of claim 10, wherein the lower jaw comprises first and second legs, with said side engagement member being movably connected to one of said legs.

15. The clamp of claim 14, wherein said side engagement member is movable with respect to the other one of said legs.

16. The clamp of claim 15, wherein said first and second legs extend in a direction generally parallel to the upper jaw.

* * * * *